United States Patent [19]

Braun

[11] Patent Number: 5,018,966

[45] Date of Patent: May 28, 1991

[54] STRIP DRYING OR CURING OVEN

[75] Inventor: Curt Braun, Riverside, Calif.

[73] Assignee: Hunter Engineering Company, Inc., Riverside, Calif.

[21] Appl. No.: 326,165

[22] Filed: Mar. 20, 1989

[51] Int. Cl.[5] ..... F27B 9/28

[52] U.S. Cl. ..... 432/59; 432/72; 432/8; 432/75; 432/2

[58] Field of Search ..... 432/8, 59, 77.2, 145, 432/152, 3, 75

[56] References Cited

U.S. PATENT DOCUMENTS

| | | | |
|---|---|---|---|
| 3,415,503 | 12/1968 | Beck | 432/152 |
| 4,245,569 | 1/1981 | Fallon, III | 110/215 |
| 4,475,294 | 10/1984 | Henricks | 432/72 |
| 4,553,929 | 11/1985 | Kanatani et al. | 432/59 |
| 4,662,840 | 5/1987 | Ellison | 432/8 |
| 4,752,217 | 6/1988 | Justus | 432/72 |
| 4,856,986 | 8/1989 | Macocco et al. | 432/72 |

*Primary Examiner*—Henry C. Yuen

*Attorney, Agent, or Firm*—Christie, Parker & Hale

[57] ABSTRACT

An oven for drying and curing a film of paint, ink, or the like on a continuous strip of metal has a non-rectangular, and preferably oval, elongated oven chamber without sharp internal corners. By avoiding sharp corners in the oven, air flow is more uniform and deposits of condensed fumes are minimized. In some embodiments no internal bracing structure required. The absence of internal structure is permitted by the oven's walls, oval shaped in transverse cross section, which result a naturally self supporting structure. Cleaning nozzles may be provided for washing the inside of the oven without need for people to enter the oven.

17 Claims, 2 Drawing Sheets

STRIP DRYING OR CURING OVEN

FIELD OF THE INVENTION

The present invention relates generally to the field of convection ovens and particularly to convection ovens used for drying and curing paint, ink or pretreatment films applied to one or both sides of a strip.

BACKGROUND OF THE INVENTION

In the metal strip painting and coating industries, it has long been the practice to pass painted, coated or inked metal strip through elongated horizontal curing ovens, in which the strip hangs in a relatively flat catenary curve from rollers set at the entrance and exit ends of the oven. Alternatively, the strip may be suspended within the oven by an air flotation system or a combination of catenary and flotation systems as shown in U.S. Pat. No. 4,242,087.

As the strip travels through the oven in one direction, heated air is forcibly circulated within the oven so that convection heat transfer rapidly dries and cures the paint, ink or other material applied to the strip. This is to be contrasted with furnaces which usually have radiant heating with no more than natural circulation of the atmosphere within the furnace. Curing ovens for metal strip are currently constructed of sheet metal and are typically as much as ten feet high by ten feet wide, or more, in transverse cross section, and from approximately 100 to 200 feet or more in length. The generally rectangular tube shape of current ovens require considerable internal and external bracing for maintaining the integrity of the ceiling and walls of the oven chambers.

A problem associated with current curing ovens is that the internal bracing creates angled surfaces which collect paint particles, fume condensation, and other debris, increasing the frequency of cleanings required for the oven. The internal bracing is additionally more difficult to clean than the other surfaces of the ovens.

Another problem arising in present rectangular ovens arises from non-uniform temperature distribution and airflow within the oven. This may create safety hazards in that flammable materials accumulate where temperatures are low or the air flow is stagnant. The paints and inks used in metal strip painting and coating contain flammable organic solvents. The flammability of these solvents require that the temperature and composition of the air in the oven be closely controlled. For most paint and ink coatings, it is desirable to maintain a constant air temperature of about 500° F. Eddies and vortices caused by corners of the oven, however, cause pressure and temperature differentials to occur within the oven. This results in unwanted overheated and cool areas to occur within the oven.

Overheated areas of an oven may reach temperatures sufficient to reach the flash point of the solvents evaporating from the painted metal strip. When this happens an explosion may occur.

The internal corners of a forced circulation oven create undesirable cool and stagnant areas. Cool air enters the oven, particularly when an oven is operated at a slight negative pressure. Vortexes due to corners and internal structure in the oven may cause substantial temperature differences to occur in the oven, particularly in corner areas which have poor air circulation, and which may inherently be cooler anyway. Cooler air entrained in the main circulation of air in the oven may enhance temperature non-uniformities in the strip as well.

The cooler areas of the oven may result in the condensation of fumes evaporated from the coating materials, creating a fire hazard. Many coating materials include volatile components which condense on the walls of the oven where cool. Deposits of sticky dust build up in such areas Such deposits may accumulate to the point where pieces fall off, leaving blemishes on the coated surfaces being cured. The convection ovens, therefore, require frequent cleaning. This is a difficult, unpleasant and time consuming task. Manways are provided through the walls of the oven for people to enter and wash down the walls. Although the deposits usually wash off with blasts of water, considerable time can be wasted during cleaning. Further, to save time during cleaning, people enter the oven while it is still quite warm, which is both unpleasant and hazardous.

It is, therefore, desirable to provide means for not only minimizing condensation of undesirable deposits within the oven, but also to facilitate cleaning when deposits do occur.

SUMMARY OF THE INVENTION

The present invention comprises an oven for drying or curing a film on a continuous strip. The oven has an elongated oven chamber with a non-rectangular transverse cross section without sharp internal corners. Preferably, the cross section is curved so that the oven may have all of its supporting structure located on the outside of the oven. Means are provided for passing a coated strip through the oven from the entrance end to the exit end. Additional means are provided for circulating heated air within the oven for drying or curing the coated strip. Preferably, nozzles are provided for washing the interior of the oven.

The strip may be supported by tension rollers set at the entrance and exit ends of the oven between which the strip is suspended in a relatively flat catenary curve. Alternatively, the strip may be supported within the oven by an air flotation system, or a combination of the suspension and flotation systems.

In a presently preferred embodiment the transverse cross section of the oven's walls comprises an oval. In other embodiments the transverse cross section of the walls comprises curved and straight sections, or is polygonal without sharp internal corners.

BRIEF DESCRIPTION OF THE DRAWINGS

The foregoing and other advantageous and distinguishing features of the invention are described in detail below and illustrated in the accompanying drawings wherein.

DETAILED DESCRIPTION

The invention is described in its presently preferred embodiment as having an oval transverse cross section for use by the strip coating industry. Coatings of paint, ink, or the like are applied to metal strips on production lines, referred to in the art as "coating lines" or "paint lines." The metal strips are preferably supplied to and removed from coating lines in the form of rolled coils. The metal strip is uncoiled, coated, dried and cured, cooled, and recoiled in one continuous process. The painting and curing process may be also combined with other treatments to the metal strip between the uncoiling and recoiling steps.

Present curing ovens have a rectangular transverse cross section with sharp corners. In its broadest aspect, this invention provides an oven with a nonrectangular cross section without sharp corners. This type of transverse cross section preferably has curved edges such as may be provided by rounding the corners of a rectangular section, or by making most or all of the cross section with curved edges. Alternatively, the cross section may be polygonal with the corners meeting at angles substantially greater than 90°, for example, a hexagonal or octagonal cross section. A presently preferred embodiment has an oval cross section.

By avoiding the sharp, 90° corners of a rectangular oven, vortexes and relatively cold areas in the corners of the oven can be minimized, leading to reduced condensation of fume in the cold, stagnant corner areas. Better air circulation within the oven also leads to better uniformity of temperature distribution across the width of the strip being cured. For example, it is often important to maintain the total temperature difference across the full width of the sheet to less than 5° C. Cool air entrained from adjacent oven zones and from cooler corner areas can be minimized, and any cooler air entrained becomes mixed with warmer air and achieves better temperature uniformity.

Figure 1:
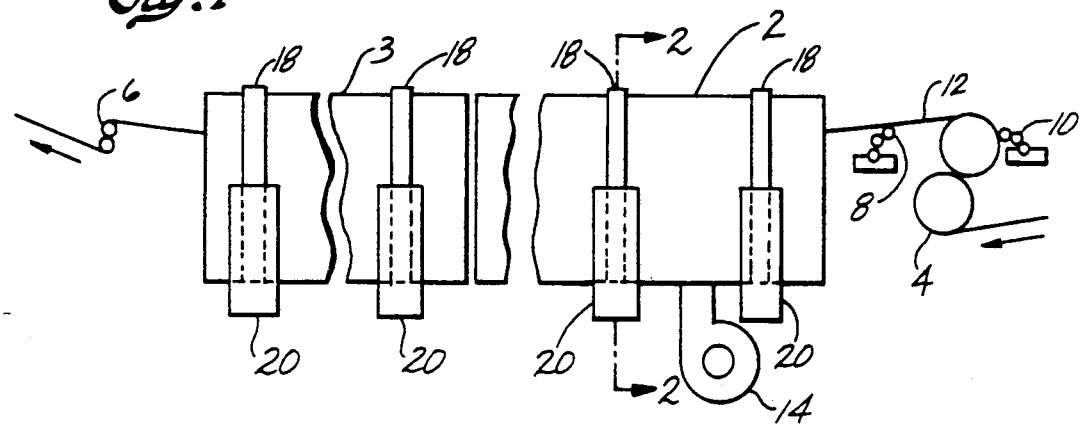
FIG. 1 is a side elevation view of an oven according to a presently preferred embodiment of the invention.
Figure 2:
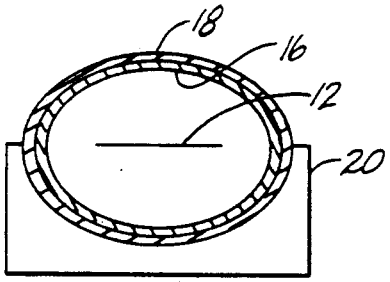
FIG. 2 is a cross sectional view taken along line 2—2 of FIG. 1.

FIG. 1 shows schematically an exemplary coating line in which a presently preferred embodiment of the present invention is used. The coating line comprises an elongated oven 2 followed by an elongated cooling chamber 3, with a tension bridle 4 at the entrance end of the oven, and a tension bridle 6 at the exit end of the cooling chamber. Conventional rollers 8 and 10 at the entrance end of the oven apply a coating to the top and bottom surfaces, respectively, of a continuous metal strip 12. The strip 12 is usually aluminum or steel, although it may be any material and may be in any width or gauge. The coating may be applied by any of a variety of conventional techniques, such as powder coating, electrostatic coating, extrusion, dipping, flow curtains, etc.

The tension bridles 4 and 6 are driven by motors (not shown) and are synchronized to exert tension of the strip during its passage through the oven 2. The strip normally hangs by gravity in a relatively flat catenary curve between the bridles. The strip enters the oven through an entrance slit (not shown) in the right-hand end of the oven as seen in FIG. 1 and exits through a exit slit (not shown) in the left-hand end of the oven as shown in FIG. 1. The strip then passes into a cooling chamber 3 where it is cooled by convection of cool air before being recoiled or conveyed to subsequent processing. Alternatively, the strip may be supported in the oven and cooling chamber by flotation on a cushion of air in a manner now conventional.

Hot gas is forcibly circulated in the oven by a plurality of blowers 14, passed over the coating film on the strip, and exhausted by means well known in the art.

In an exemplary embodiment, the oven comprises an oval oven wall 16 supported by oval shaped stiffeners 18 and cradles 20. The exterior surface of the oven is covered with a layer of insulation (not shown for clarity). The oven wall may be constructed of metal sheets rolled to a curved shape, butt or lap joined together and fixed within the oval shaped stiffeners 18. The thickness of the metal sheets and the distance between stiffeners is such as to permit a man to walk and perform cleaning operations within the oven without damaging the oven wall or floor. The cradles 20 are formed to permit the stiffeners 18 to be attached to them. Additional stiffeners and cradles, beyond those required to support the walls and a man walking within the oven, may be placed on the oven, as required to provide structural support for any equipment located within the oven, such as air circulation blowers and ducts, flotation plenums or the like.

The cooling chamber 3 is formed with a cross section similar to that of the oven, and may be considered to be part of the oven. The oven interior has a plurality of heating zones, typically about six to twelve, along its length. The cooling zone in the cooling chamber is similar, differing by having a partial barrier between the ends of the cooling chamber and the oven to minimize mixing of hot and cool air. In other embodiments there may not be an air cooling chamber, and the strip may be water quenched for cooling before recoiling.

Figure 3:
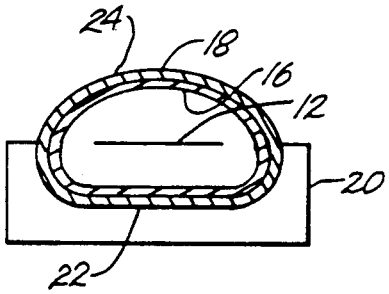
FIG. 3 is a section view of another embodiment of an oven taken along line 2—2 of FIG. 1.

Many of the benefits of the presently preferred embodiment of the present invention may be achieved with other embodiments having walls shaped in differing transverse cross sections. For example, a cross section having curved and straight sections may be used. An example is a transverse cross section having a relatively flat floor 22 and an arched top 24 as shown in FIG. 3. In such an embodiment, the natural self supporting strength of the oval or arch shape may be used to form an oven which does not require the use of internal stiffeners for support.

Figure 4:
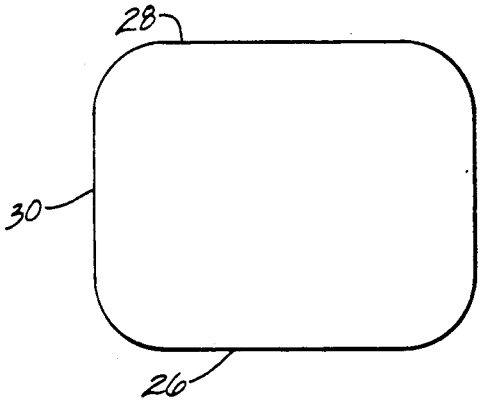
FIG. 4 is a schematic cross section of another embodiment of oven which may be a modification of an existing rectangular oven.
Figure 5:
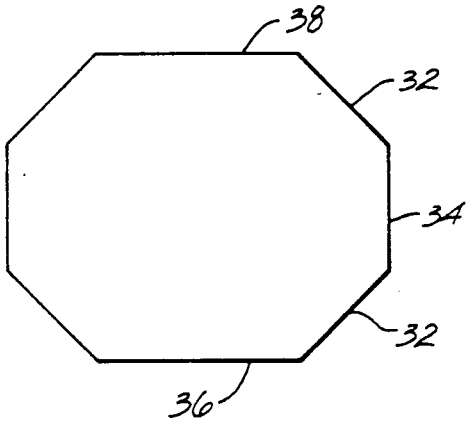
FIG. 5 is a schematic cross section of still another embodiment of oven.
Figure 6:
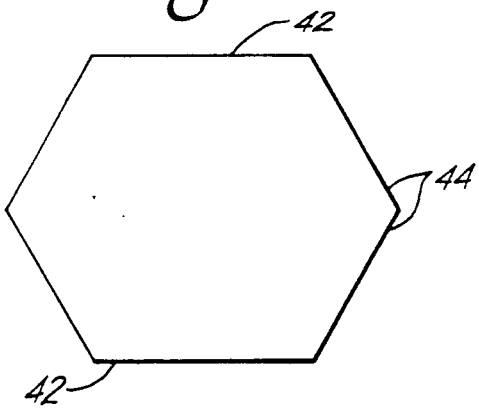
FIG. 6 is a schematic cross section of another embodiment of polygonal oven.

FIGS. 4 to 6 illustrate other transverse cross sections which are suitable for practice of this invention. The cross section of FIG. 4 is particularly useful. It has a flat floor 26 on which personnel may walk during clean-up. The top 28 of the oven is flat. The "corners" between the side walls of the oven and the floor and top are rounded with a generous radius so that there are no sharp corners within the oven. The side walls may have flat central portions as illustrated, or t hey may have more or less continuous curvature between the top and bottom of the oven. This embodiment is particularly advantageous since existing rectangular cross section ovens may be converted to the advantageous low vortex cross section by welding or bolting curved sheets along the length of the oven to blank off the troublesome corners.

FIG. 5 illustrates another way of converting existing rectangular cross section ovens to the desirable non-rectangular cross section without sharp internal corners. In this embodiment diagonal sheets 32 are welded or bolted in the corners between the side walls 34 and floor 36 or top 38 of the oven to generate an octagonal cross section. Clearly, if desired, an oven may be built with such an octagonal cross section to begin with.

FIG. 6 illustrates still another representative cross section for a curing oven. In this embodiment the floor 40 and top 42 of the oven are joined by side walls 44 which are bent to form a generally hexagonal cross section. This embodiment is free of the sharp right angle corners of the rectangular cross section in conventional curing ovens, preferably having corners with about 120° included angles. In such an embodiment, vortexes and cold corners are substantially reduced as compared with a rectangular oven.

When compared to the prior art rectangular oven shape, the oval oven is a more naturally self supporting structure. Oval ovens may, therefore, be practically and less expensively constructed with all their structural features on the outside. The absence of internal bracing avoids the angled surfaces of the braces of current ovens. This reduces the frequency of required cleanings of the oval oven. The reduction of internal structure also makes the cleaning of the oven easier.

The non-rectangular cross section without sharp internal corners, and the absence of internal bracing of the present invention additionally result in better air circulation within the oven. Reduced eddies and vortexes result in more uniform temperatures in the oven, reducing the hazards of solvent vapor explosion due to overheating. Fires from fume condensation are also reduced by the more constant temperature maintained and from the elimination of the corner cooling effects of rectangular ovens.

Another benefit of the oval oven shape, when compared to a rectangular oven of equal width and strip curing capacity, is that the oval oven contains a reduced peripheral surface area. An oven with reduced peripheral surface permits a reduced volume of heated air to be blown through the oven without reduction of the airflow passing by the metal strip. The reduction of the air volume needed reduces the air heating and blowing requirements of the oval oven. Use of the present invention, therefore, results in a savings of energy over the prior art and permits utilization of smaller less expensive hot air generating combustion chambers and air circulating blowers.

Figure 7:
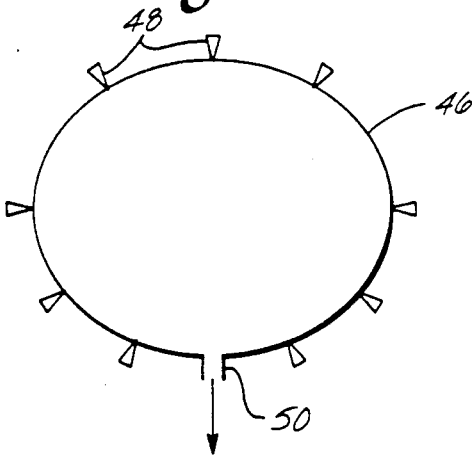
FIG. 7 is a schematic cross section of an oven with nozzles for automatic cleaning.

It is also desirable to provide means for automatically cleaning the interiors of such curing ovens. Thus, in the embodiment illustrated in FIG. 7, the oval wall 46 of the oven is fitted with a plurality of high pressure nozzles 48 around the perimeter which collectively spray water or solvent cleaning solutions onto the opposite walls of the oven to dislodge condensation. In the event there is internal structure within the oven, such as, for example, flotation plenums or the like, nozzles may also be arranged for spray cleaning such structure. Some of such nozzles may be mounted within the oven, rather than being arranged around the walls of the oven. The cleaning solution used is discharged through drains 50 along the lower part of the oven, to be filtered and reused for cleaning the oven. In an oven with a nominally flat floor, it is desirable to provide a built-in pitch to drains so that cleaning solutions are readily discharged.

Spray nozzles may also be mounted on pipes within the oven, and need not be fixed, but may also be arranged to pivot to assure thorough cleaning of all portions of the inside of the oven, including any structure mounted inside the oven. Such embodiments with automatic cleaning minimize the need to send personnel into the oven for cleaning. Further, even if personnel do need to enter for cleaning parts of the interior not adequately cleaned by the spray nozzles, the initial cleaning by the sprays rapidly cools the oven so that personnel can enter earlier, and the entire cleaning cycle is shortened.

Having now described the invention in accordance with the requirements of the patent statutes, those skilled in this art will have no difficulties making changes and modifications in the embodiment of the individual elements of the invention in order to meet their specific requirements or conditions. Such changes and modifications may be made with out departing from the scope and spirit of the invention as set forth in the following claims.

What is claimed is:

1. A curing or drying oven for a continuous strip comprising:
   - an elongated oven chamber having walls curved in transverse cross section;
   - means for passing a coated strip through the oven from the entrance end to the exit end;
   - means for circulating heated air within the oven for heating the coated strip; and
   - means for spraying cleaning solution inside the oven for cleaning the oven.

2. An oven as recited in claim 1 wherein all of the supporting structure of the oven wall is located outside of the oven.

3. An oven as recited in claim 1 wherein the transverse cross section of the oven comprises an oval.

4. An oven as recited in claim 1 wherein the transverse cross section of the oven comprises curved and straight sections.

5. An oven as recited in claim 1 wherein the transverse cross section of the oven comprises straight floor, top and side walls and non-right angle transitions between the floor, top and side walls.

6. An oven as recited in claim 5 wherein the transitions are curved.

7. An elongated strip drying or curing oven comprising:
   - an oven shell having a generally oval transverse cross section;
   - means for supporting the shell along its length so that an upper portion of the shell forms an arch;
   - means for passing a continuous strip longitudinally through the shell;
   - means for circulating heated air within the oven for heating such a strip; and
   - means for spraying cleaning solution inside the oven for cleaning the oven.

8. An oven as recited in claim 7 wherein all of the supporting structure of the oven is located on the outside of the oven.

9. A curing or drying oven for a continuous strip comprising:
   - an elongated oven chamber having a non-rectangular transverse cross section without sharp internal corners;
   - means for passing a coated strip through the oven from the entrance end to the exit end;
   - means for circulating heated air within the oven for heating and coated strip; and
   - means for spraying cleaning solution inside the oven for cleaning the oven.

10. An oven as recited in claim 9 wherein the transverse cross section of the oven comprises an oval.

11. An oven as recited in claim 10 wherein all of the supporting structure of the oven wall is located outside of the oven.

12. An oven as recited in claim 9 wherein the transverse cross section of the oven comprises curved and straight sections.

13. An oven as recited in claim 9 wherein the transverse cross section of the oven comprises straight floor, top and side walls and non-right angle transitions between the floor, top and side walls.

14. An oven as recited in claim 13 wherein the transitions are curved.

15. An oven as recited in claim 9 wherein the transverse cross section of the oven is octagonal.

16. An oven as recited in claim 9 wherein the transverse cross section of the oven is hexagonal.

17. An elongated strip drying or curing oven comprising:

an elongated oven shell having an entrance and an exit at opposite ends;

means for passing a continuous strip longitudinally through the shell between the entrance and the exit;

means for circulating heated air within the oven for heating such a strip; and means for spraying cleaning solution inside the oven for cleaning the oven.

* * * * *